US008966800B1

(12) United States Patent
Olson

(10) Patent No.: US 8,966,800 B1
(45) Date of Patent: Mar. 3, 2015

(54) WIDE-FLANGED CARTRIDGE EXTRACTOR

(75) Inventor: Clifford W. Olson, Easton, CT (US)

(73) Assignee: Innovative Tool and Advanced Weapon Solutions, LLC, Easton, CT (US)

( * ) Notice: Subject to any disclaimer, the term of this patent is extended or adjusted under 35 U.S.C. 154(b) by 48 days.

(21) Appl. No.: 13/548,168

(22) Filed: Jul. 12, 2012

Related U.S. Application Data

(60) Provisional application No. 61/572,798, filed on Jul. 22, 2011.

(51) Int. Cl.
*F41A 15/10* (2006.01)
*F41A 15/14* (2006.01)
*F41A 15/12* (2006.01)

(52) U.S. Cl.
CPC ..... *F41A 15/14* (2013.01); *F41A 15/12* (2013.01); *F41A 15/10* (2013.01)
USPC ..... 42/25

(58) Field of Classification Search
None
See application file for complete search history.

(56) References Cited

U.S. PATENT DOCUMENTS

| | | | | |
|---|---|---|---|---|
| 467,180 | A | 1/1892 | Mauser | |
| 2,198,610 | A | 4/1940 | Garand | |
| 3,253,362 | A | 5/1966 | Gitchell | |
| 3,780,618 | A | 12/1973 | Sanford | |
| 4,272,902 | A | 6/1981 | Waters | |
| 5,351,598 | A | 10/1994 | Schuetz | |
| 5,520,019 | A | 5/1996 | Schuetz | |
| 5,794,373 | A * | 8/1998 | Moon | 42/25 |
| 6,182,389 | B1 | 2/2001 | Lewis | |
| 6,609,319 | B1 | 8/2003 | Olson | |
| 7,735,410 | B2 | 6/2010 | Clark | |
| D641,451 | S | 7/2011 | Gomez et al. | |
| 8,069,600 | B2 * | 12/2011 | Rousseau et al. | 42/25 |
| 8,087,194 | B1 | 1/2012 | Vuksanovich | |
| 8,161,864 | B1 | 4/2012 | Vuksanovich | |
| 8,307,750 | B2 | 11/2012 | Vuksanovich et al. | |
| 8,387,513 | B2 | 3/2013 | Gomez et al. | |
| 2002/0073591 | A1 | 6/2002 | Schweikart | |
| 2006/0185212 | A1 * | 8/2006 | Curry et al. | 42/46 |

FOREIGN PATENT DOCUMENTS

| | | | |
|---|---|---|---|
| EP | 0 190 456 | | 5/1988 |
| FR | 371.495 | * | 3/1907 |
| GB | 25383 | * | 5/1913 |

* cited by examiner

*Primary Examiner* — Stephen M Johnson

(74) *Attorney, Agent, or Firm* — Fincham Downs, LLC; Carson C.K. Fincham

(57) ABSTRACT

Systems, methods, and articles of manufacture for wide-flanged cartridge extractors are provided.

16 Claims, 6 Drawing Sheets

WIDE-FLANGED CARTRIDGE EXTRACTOR

CROSS-REFERENCE TO RELATED APPLICATIONS

The present application is a non-provisional of, and claims benefit and priority under 35 U.S.C. §119(e) to, U.S. Provisional Patent Application No. 61/572,798 filed on Jul. 22, 2011 and titled "WIDE CLAW AMMUNITION EXTRACTION SYSTEM", the entirety of which is hereby incorporated by reference herein.

BACKGROUND

Firearms of various types and configurations often utilize extractor devices to remove cartridges from a firing chamber. While several styles of cartridge extractors are known and utilized, each of the known designs is prone to failure in extreme operating conditions (e.g., in the field during military operations). Such failures can result in physical damage to the firearm, injury, and even loss of life (e.g., firearm failure in tactical situations). It is accordingly desirable to have a cartridge extractor that is less likely to fail even under extreme operating conditions and/or that may otherwise provide benefits not available in previous designs.

BRIEF DESCRIPTION OF THE DRAWINGS

An understanding of embodiments described herein and many of the attendant advantages thereof may be readily obtained by reference to the following detailed description when considered with the accompanying drawings, wherein.

DETAILED DESCRIPTION

Embodiments presented herein are descriptive of systems, apparatus, methods, and articles of manufacture for wide-flanged cartridge extractors. In some embodiments, for example, an engaging portion or "flange" of a cartridge extractor is elongated in a transverse direction (i.e., a portion of the extractor configured to engage with a rim of an ammunition cartridge is elongated to contact a larger portion of the cartridge than a typical extractor). For non-limiting purposes of illustration and comparison, the configuration of typical ammunition extractors and systems are briefly described as follows.

Figure 1:
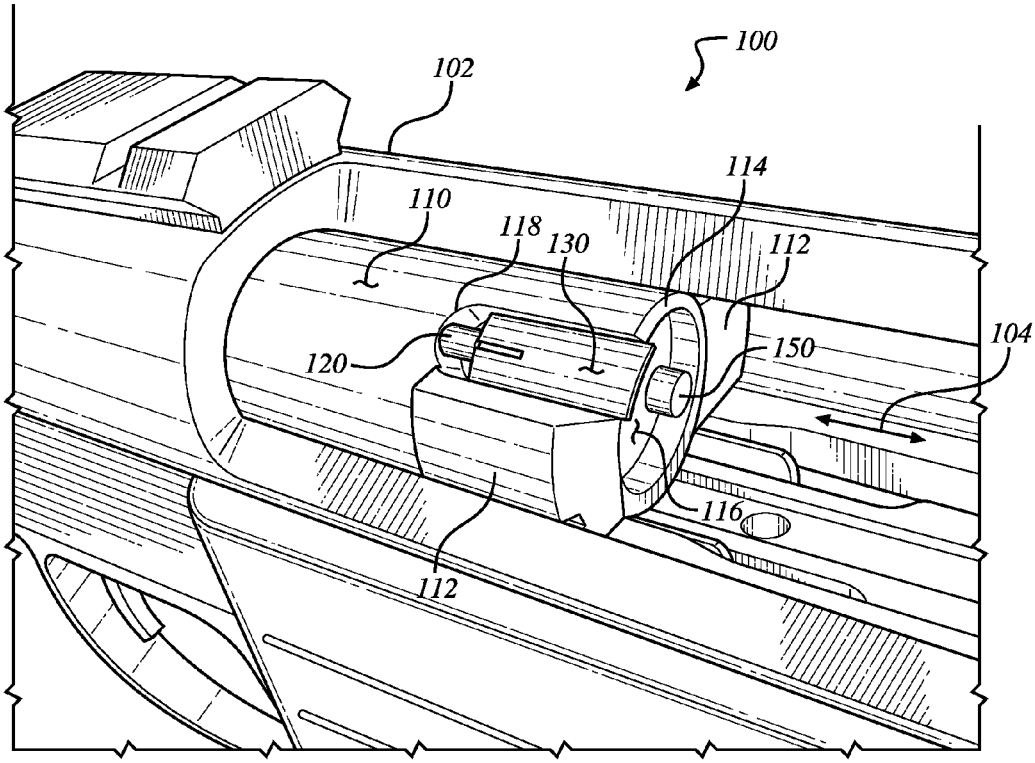
FIG. 1 PRIOR ART
FIG. 1 is a perspective diagram of a prior art firearm system.

Turning first to FIG. 1, a perspective diagram of a prior art firearm system 100 is shown. The prior art firearm system 100 of FIG. 1 may, for example, comprise an illustration of a portion of a bolt-action and/or repeating rifle. As depicted, the system 100 may comprise a receiver assembly 102 having an opening cut and/or cavity formed therein, thereby defining an ejector port 104. Disposed within the cavity comprising the ejector port 104 is a bolt 110 comprising locking lugs 112 that are configured to engage with the receiver assembly 102 and/or the side-walls of the ejector port 104. The bolt 110 may comprise an engaging face 114 and a cartridge seat 116 recessed from the engaging face 114 and configured to receive the rear of an ammunition cartridge (not shown in FIG. 1). The bolt 110 is often configured to rotatably traverse through the ejector port 104 such that the locking lugs 112, disposed within locking-lug recesses (not explicitly depicted in FIG. 1) couple the bolt 110 to the receiver assembly 102. The bolt 110 is typically configured such that upon a full traversal of the ejector port 104, the engaging face 114 engages with a breech or chamber end wall (neither of which are shown in FIG. 1), securely coupling a seated cartridge into the breech and/or chamber of the firearm system 100, and closing-off or sealing the ejector port 104.

The bolt 110 may also comprise an extractor channel 118 cut and/or formed in the side of the bolt 110. Typically disposed within the extractor channel 118 are an extractor plunger 120 engaged with an extractor 130. The extractor plunger 120 is typically acted upon by an extractor spring (not shown in FIG. 1) disposed within the bolt 110 and/or the extractor channel 118 thereof. The extractor plunger 120 accordingly exerts a force upon the extractor 130 such that a rim on the rear of a cartridge forcibly engages with and becomes coupled to the extractor 130 upon being seated in the cartridge seat 116. The engaging and/or coupling of the extractor 130 with the cartridge allows the cartridge to be removed from the breech and/or chamber as the bolt 110 is disengaged to traverse the ejector port 104 in the opposite direction, opening and/or un-sealing the ejector port 104. The system 100 may also typically comprise an ejector 150. Although different styles and configurations of ejectors 150 are utilized, a plunger-style ejector 150 is depicted in FIG. 1 for non-limiting illustration purposes. As shown, the plunger-style ejector 150 is disposed within the bolt 110 and particularly, within the recessed cartridge seat 116. The plunger-style ejector 150 is typically acted upon by a spring (not shown) within the bolt 110 that allows the plunger-style ejector 150 to exert force upon the rear of a cartridge seated in the cartridge seat 116. As the bolt 110 is disengaged to traverse through the ejector port 104 and away from the breech (e.g., after a cartridge is utilized to fire a projectile from the firearm, or otherwise), the force exerted by the plunger-style ejector 150 upon the cartridge causes the spent cartridge to be ejected from the receiver assembly 102 and/or the cavity comprising the ejector port 104. A new cartridge may then enter the cavity comprising the ejector port 104 and become seated in the cartridge seat 116 and engaged with the extractor 130, such that the process may be repeated (e.g., another projectile may be fired after being loaded into the breech and/or chamber be engaging the bolt 110. In repeating firearm systems, the new cartridge may automatically load into the cavity comprising the ejector port 104 and/or may become automatically seated within the cartridge seat 116 and engaged with the extractor 130 (e.g., from the floor of the ejector port 104 and/or otherwise from a magazine and/or clip (not explicitly shown in FIG. 1) coupled to the receiver assembly 102.

Figure 2A:
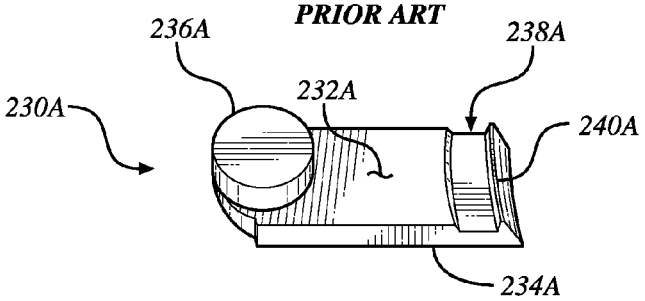
FIG. 2A PRIOR ART
FIG. 2A and FIG. 2B are perspective diagrams of prior art cartridge extractors.
Figure 2B:
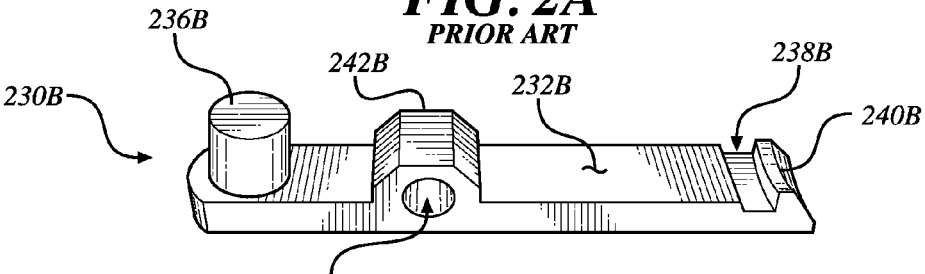
FIG. 2B PRIOR ART

Referring now to FIG. 2A and FIG. 2B, perspective diagrams of prior art cartridge extractors 230A-B are shown. The extractors 230A-B are depicted inverted to better illustrate the features thereof. A first extractor 230A comprises what is commonly referred to as a "Sako®-style" extractor. The Sako®-style extractor 230A, for example, is generally of a rectangular shape and comprises a first surface 232A and a second surface 234A. When installed in a bolt of a firearm, the Sako®-style extractor 230A rests within an extractor channel of the bolt (neither of which are shown in FIG. 2A or FIG. 2B) and the first surface 232A rests against the bottom of the channel, while the second surface 234A remains exposed and is generally disposed flush with the surface of the bolt.

The Sako®-style extractor 230A also generally comprises a protrusion 236A configured to engage with a seat (not shown) within the extractor channel of the bolt. The Sako®-style extractor 230A is typically configured to be acted upon by a force exerted on the rear of the Sako®-style extractor 230A (by an extractor spring and/or extractor plunger—neither shown in FIG. 2A; and typically exerted longitudinally along an axis parallel to the longer dimension of the rectangular Sako®-style extractor 230A), near the protrusion 236A, and to accordingly pivot within the seat, the protrusion 236A preventing the Sako®-style extractor 230A from being dislodged from the bolt when the force is applied.

The Sako®-style extractor 230A also comprises elements configured to engage and/or couple with a cartridge (not shown). A cartridge rim channel 238A, for example, is cut and/or formed into the first surface 232A near the end of the Sako®-style extractor 230A opposite the protrusion 236A. The cartridge rim channel 238A is typically configured such that a cartridge engaging flange 240A (or "hook" or "claw") is formed at and/or near the tip of the Sako®-style extractor 230A. When installed in the bolt of a firearm, the cartridge rim channel 238A is configured to reactive the rim at the rear of an ammunition cartridge and the cartridge engaging flange 240A is configured to retain the rim of the cartridge within the cartridge rim channel 238A (e.g., until forcibly-ejected, such as by an ejector device of the bolt—not shown in FIG. 2A or FIG. 2B).

A second extractor 230B comprises what is commonly referred to as an AR-15/M-16-style extractor. The AR-15/M-16-style extractor 230B, for example, is generally of a rectangular shape, but more elongated than the Sako®-style extractor 230A. The first surface 232B of the AR-15/M-16-style extractor 230B comprises a housing 242B formed thereon, the housing 242B comprising (or defining) a pin hole 244B. The AR-15/M-16-style extractor 230B is configured to operate in a slightly different manner than the Sako®-style extractor 230A. The AR-15/M-16-style extractor 230B, for example, comprises a protrusion 236B that is configured to be acted upon by a force (typically a spring—not shown) that pushes the rear of the AR-15/M-16-style extractor 230B (at the protrusion 236B) such that the AR-15/M-16-style extractor 230B pivots about the pin hole 244B. The AR-15/M-16-style extractor 230B is typically secured to the bolt of a firearm via a pin (not shown) inserted through the pin hole 244B and engaged with one or more aligned holes in the side-wall of the extractor channel of the bolt. Like the Sako®-style extractor 230A, the AR-15/M-16-style extractor 230B comprises a cartridge rim channel 238B cut and/or formed in the first surface 232B, and a cartridge engaging flange 240B.

Figure 3A:
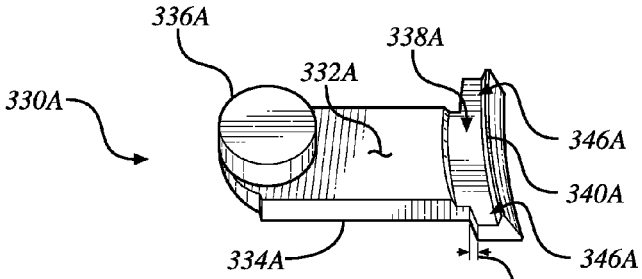
FIG. 3A and FIG. 3B are perspective diagrams of cartridge extractors according to some embodiments.
Figure 3B:
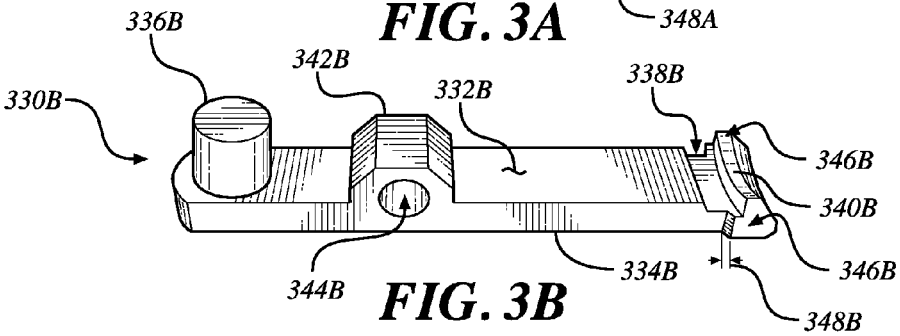

Referring now to FIG. 3A and FIG. 3B, perspective diagrams of cartridge extractors 330A-B according to some embodiments are shown. A first cartridge extractor 330A may comprise a Sako®-style extractor configured in accordance with some embodiments, for example, and/or a second cartridge extractor 330B may comprise an AR-15/M-16-style extractor configured in accordance with some embodiments. In some embodiments, the first cartridge extractor 330A may comprise a first surface 332A and a second surface 334A. In some embodiments, the first surface 332A and the second surface 334A may comprises surfaces of and/or define a standard rectangular shaped portion of the first cartridge extractor 330A. In some embodiments, the first cartridge extractor 330A may comprise a protrusion 336A at one end of the first cartridge extractor 330A.

According to some embodiments, the first cartridge extractor 330A may comprise a cartridge rim channel 338A cut and/or formed in the first surface 332A, the cartridge rim channel 338A forming, defining, and/or configured to operate in conjunction with a cartridge engaging flange 340A.

In some embodiments, the second cartridge extractor 330B may comprise a first surface 332B and a second surface 334B. In some embodiments, the first surface 332B and the second surface 334B may comprises surfaces of and/or define a standard rectangular shaped portion of the second cartridge extractor 330B. In some embodiments, the second cartridge extractor 330B may comprise a protrusion 336B at one end of the second cartridge extractor 330B. In some embodiments, the second cartridge extractor 330B may comprise a housing 342B formed on and/or coupled to the first surface 332B, the housing 342B comprising and/or defining a pin hole 344B.

According to some embodiments, the second cartridge extractor 330B may comprise a cartridge rim channel 338B cut and/or formed in the first surface 332B, the cartridge rim channel 338B forming, defining, and/or configured to operate in conjunction with a cartridge engaging flange 340B.

In some embodiments, the cartridge extractors 330A-B may comprise (e.g., at and/or near the engaging end comprising the cartridge rim channels 338A-B and the cartridge engaging flanges 340A-B) elongated flange portions 346A-B. The elongated flange portions 346A-B may, for example, extend the cartridge rim channels 338A-B and/or the cartridge engaging flanges 340A-B transversely beyond the dimensions of the rectangular portion of the first surfaces 332A-B and/or the second surfaces 334A-B. In some embodiments, the elongated flange portions 346A-B may protrude transversely from the standard rectangular portion of the cartridge extractors 330A-B by extension amounts 348A-B.

In such a manner, for example, various advantages over prior art ammunition extractors (such as the extractors 230A-B of FIG. 2A and/or FIG. 2B) may be realized. In the case that a cartridge becomes lodged and/or "jammed" in the breech and/or chamber, for example, the bolt must often be forcibly disengaged with a substantial amount of force (e.g., in an attempt to clear the jammed cartridge). With prior art extractors, such events may cause the extractor (which is typically made of steel and/or other high-strength metals) to exert large amounts of extraction force on the rim of the jammed cartridge. As most cartridges are made of copper or other metals having much less strength than the extractor, the prior art extractors may, in such circumstances, shear-off a portion of the cartridge rim and/or otherwise damage the jammed cartridge. The damage to the cartridge caused by the prior art extractors in such circumstances may produce various undesirable results. The damaged cartridge may remain jammed in the breech and/or chamber (e.g., with a portion of the rim ripped-off), the cartridge may become ripped-apart, leaving a portion lodged in the breech and/or chamber, and/or portions of the damaged cartridge may become lodged in other portions of the firearm (e.g., the magazine, the locking-lug recesses, etc.). Particularly in tactical situations faced by military and/or police personnel, such adverse results could lead to injury or loss of life.

Utilization of the elongated flange portions 346A-B of the cartridge extractors 330A-B, however, may reduce the likelihood of such adverse results occurring. The elongated flange portions 346A-B, for example, allow the cartridge extractors 330A-B to spread the applied extraction force over a larger area of the rim of the cartridge to be extracted. Application of the force over a larger area results in less pressure on the rim of the cartridge, and accordingly less likelihood of catastrophic cartridge structural failure. In some embodiments, the extension amounts 348A-B may be about one-half of the width of the standard rectangular portion of the cartridge extractors 330A-B. In such a manner, for example, each cartridge extractor 330A-B in accordance with some embodiments herein may comprise a cartridge engaging flange 340A-B (and/or cartridge rim channel 338A-B) having approximately twice as much cartridge-engaging area as a typical extractor.

In some embodiments, the extension amounts 348A-B may be sized to increase the cartridge-engaging area of the cartridge engaging flange 340A-B (and/or cartridge rim channel 338A-B) by approximately seventy-five percent (75%) over typical extractors. In some embodiments, any extension amounts 348A-B that extend the cartridge engaging flanges 340A-B (and/or cartridge rim channel 338A-B) beyond the width of the standard rectangular shaped portion of a typical extractor, may be utilized to reduce the likelihood of firearm system failures. In some embodiments, the extension amounts 348A-B may be sized to increase the cartridge-engaging area of the cartridge engaging flange 340A-B (and/or cartridge rim channel 338A-B) (i) in a range of one percent (1%) to one hundred percent (100%) over typical extractors, or (ii) in a range of seventy-five percent (75%) to one hundred percent (100%) over typical extractors.

According to some embodiments, any or all of the components 332A-B, 334A-B, 336A-B, 338A-B, 340A-B, 346A-B, 348A-B of the cartridge extractors 330A-B (and/or the extractors 330A-B themselves) may be similar in configuration and/or functionality to any similarly named and/or numbered components described herein. Fewer or more components 332A-B, 334A-B, 336A-B, 338A-B, 340A-B, 346A-B, 348A-B (and/or portions thereof) and/or various configurations of the components 332A-B, 334A-B, 336A-B, 338A-B, 340A-B, 346A-B, 348A-B may be included in the cartridge extractors 330A-B without deviating from the scope of embodiments described herein. In some embodiments, one or more of the various components 332A-B, 334A-B, 336A-B, 338A-B, 340A-B, 346A-B, 348A-B may not be needed and/or desired in the cartridge extractors 330A-B.

Figure 4:
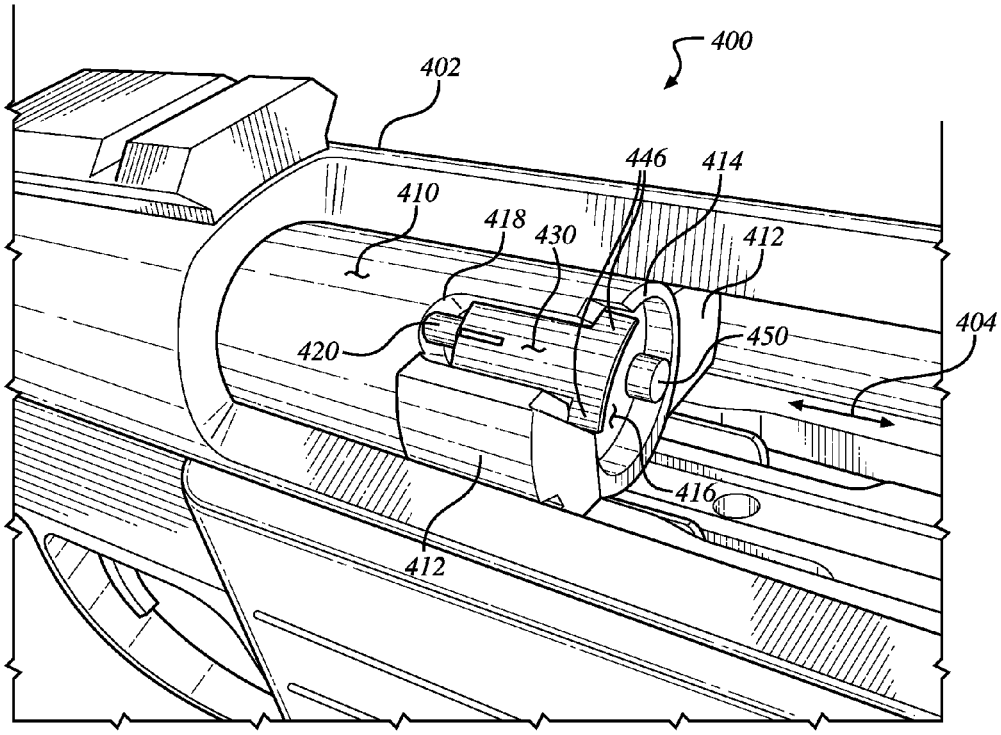
FIG. 4 is a perspective diagram of a firearm system according to some embodiments.
Figure 5A:
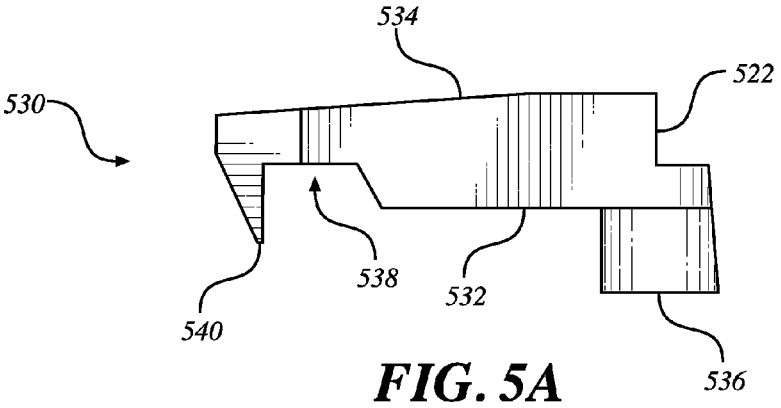
FIG. 5A, FIG. 5B, FIG. 5C, and FIG. 5D are side, top, rear, and front views of a cartridge extractor according to some embodiments.
Figure 5B:
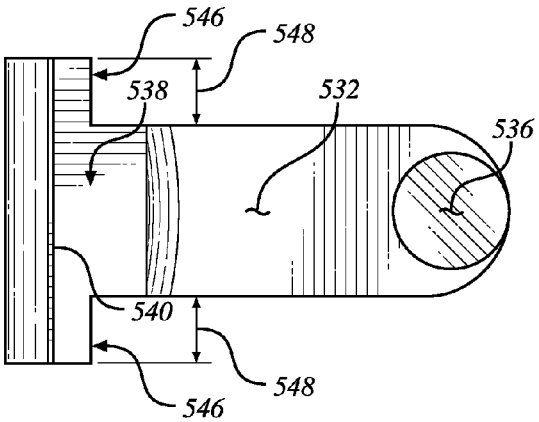
Figure 5C:
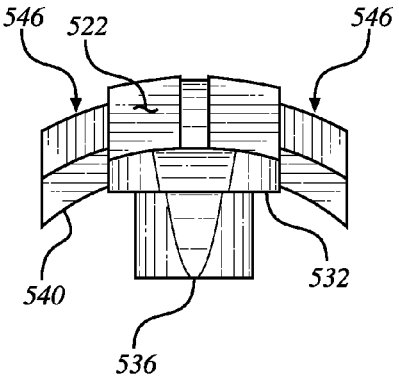
Figure 5D:
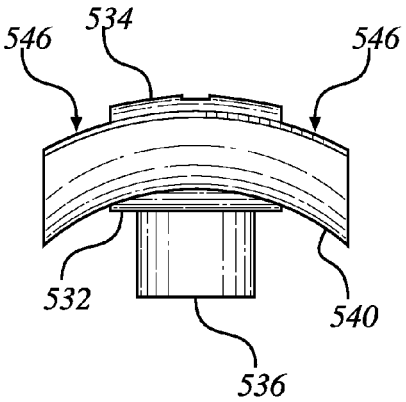
Figure 6A:
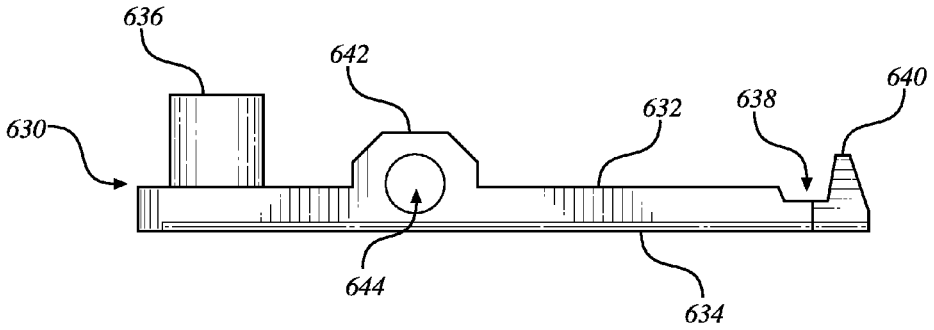
FIG. 6A, FIG. 6B, FIG. 6C, and FIG. 6D are side, top, rear, and front views of a cartridge extractor according to some embodiments.
Figure 6B:
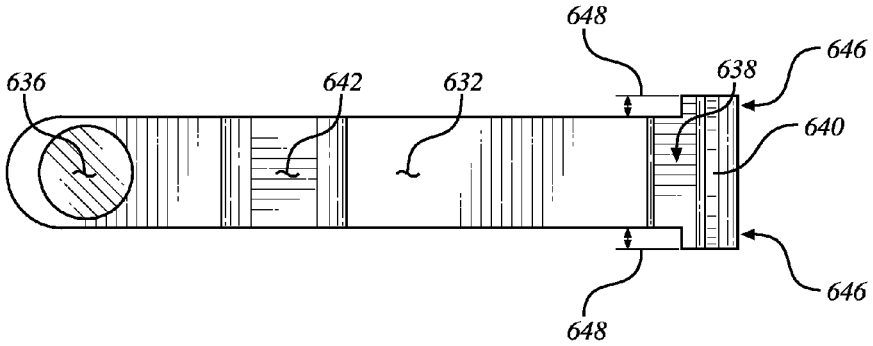
Figure 6C:
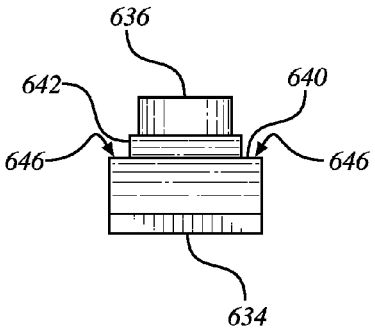
Figure 6D:
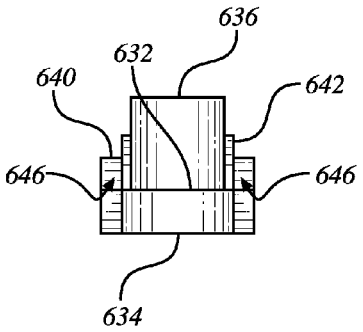
Figure 7A:
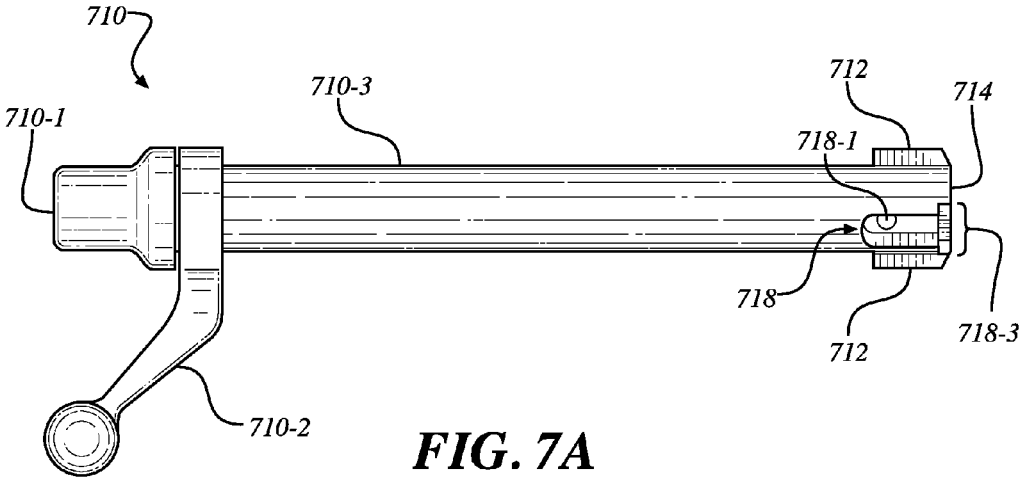
FIG. 7A, FIG. 7B, FIG. 7C, and FIG. 7D are side, top, front, and rear views of a firearm bolt assembly according to some embodiments.
Figure 7B:
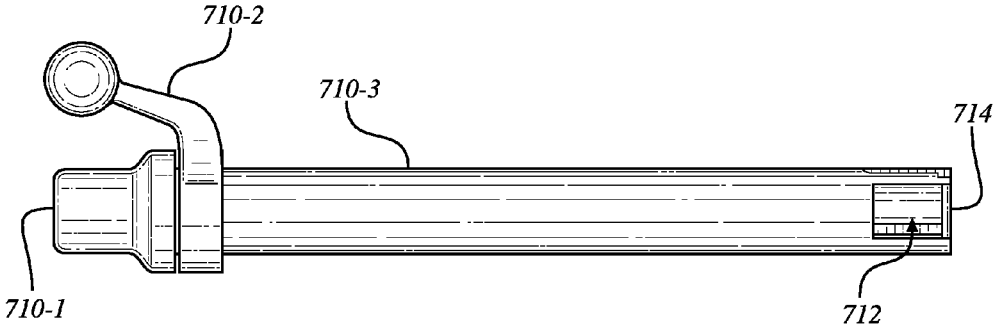
Figure 7C:
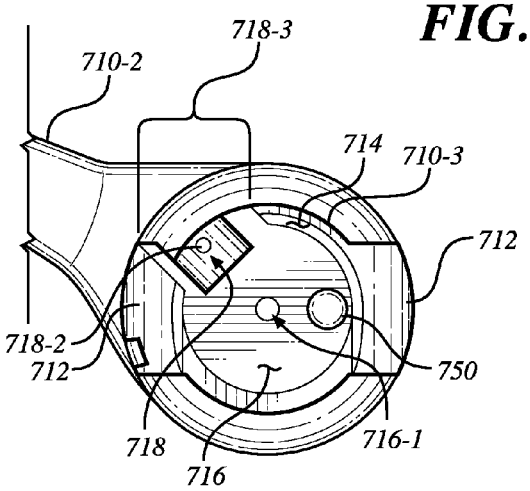
Figure 7D:
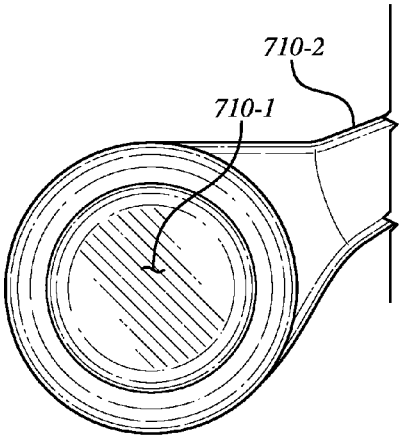

Turning to FIG. 4, a perspective diagram of a firearm system 400 according to some embodiments is shown. In some embodiments, the firearm system 400 may comprise a receiver assembly 402 having a cutout and/or cavity defining an ejector port 404. The firearm system 400 may comprise a bolt 410 disposed within the receiver assembly 402 and/or cavity defining the ejector port 404. According to some embodiments, the bolt 410 may comprise one or more locking lugs 412, an engaging face 414, a cartridge seat 416, and/or an extractor channel 418. Disposed within the extractor channel 418, in some embodiments, may be an extractor plunger 420 and/or a wide-flanged extractor 430. For non-limiting purposes of illustration only, the wide-flanged extractor 430 depicted in FIG. 4 is a modified Sako®-style extractor. In some embodiments, other styles and/or configurations of wide-flanged extractors 430 may be utilized. In some embodiments, the wide-flanged extractor 430 may comprise flange extensions 446 (e.g., causing the wide-flanged extractor 430 to have a wider flange than typical extractors). According to some embodiments, the firearm system 400 and/or the bolt 410 may comprise an ejector 450 (depicted solely for non-limiting purposes of illustration as a plunger-style ejector).

The firearm system 400 may, for example, be similar to the firearm system 100 of FIG. 1 herein, although equipped with a wide-flanged extractor 430 as opposed to a typical extractor 130. According to some embodiments, any or all of the components 402, 404, 410, 412, 414, 416, 418, 420, 430, 446, 450 of the firearm system 400 may be similar in configuration and/or functionality to any similarly named and/or numbered components described herein. Fewer or more components 402, 404, 410, 412, 414, 416, 418, 420, 430, 446, 450 (and/or portions thereof) and/or various configurations of the components 402, 404, 410, 412, 414, 416, 418, 420, 430, 446, 450 may be included in the firearm system 400 without deviating from the scope of embodiments described herein. In some embodiments, one or more of the various components 402, 404, 410, 412, 414, 416, 418, 420, 430, 446, 450 may not be needed and/or desired in the firearm system 400.

In some embodiments, the wide-flanged extractor 430 may be acted upon by the extractor plunger 420 to pivot in the extractor channel 418 of the bolt 410 and accordingly be configured to forcibly but removably engage with and/or couple to a rim of an ammunition cartridge (not shown in FIG. 4). In some embodiments, the flange extensions 446 may seat within a portion of the extractor channel 418 that extends transversely from the main extractor channel 418, near and/or at the engaging face 414 of the bolt 410. In such a manner, for example, a disengaging movement of the bolt 410 in the receiver assembly 402 and/or through the ejector port 404 may cause the wide-flanged extractor 430 to exert a smaller extraction pressure on the rim of a cartridge than a typical extractor (e.g., not having one or more of the flange extensions 446) would. This reduced extraction pressure due to the utilization of the wide-flanged extractor 430 may increase extraction reliability, reduce the probability of catastrophic cartridge structural failure when clearing a jammed cartridge, and/or may otherwise provide benefits realized upon operation of the firearm system 400.

In some embodiments, the wide-flanged extractor 430 may be sized such that the extractor channel 418 may be sized as in current firearm systems. In other words, the extractor channel 418 may be machined and/or otherwise formed in accordance with typical manufacturing and/or gun-smithing procedures, and the main portion of the wide-flanged extractor 430 will, in some embodiments, fit into this standard extractor channel 418. This reduces production costs and maintains bolt integrity by not requiring the removal of more material from the bolt 410 to form the extractor channel 418 than in typical systems—maintaining strength and reliability. In some embodiments, the portion of the extractor channel 418 that extends transversely from the main extractor channel 418 an in which the flange extensions 446 are seated requires only a single extra cut into the engaging face 414 of the bolt 410, which does not materially affect the bolt structure. According to some embodiments, the locking lugs 412 may also be minimally affected by creation of the transverse cut, which allows for implementation of the wide-flanged extractor 430 without sacrificing strength or reliability of the bolt 410 or the firearm system 400.

Referring now to FIG. 5A, FIG. 5B, FIG. 5C, and FIG. 5D, side, top, rear, and front views of a cartridge extractor 530 according to some embodiments are shown. The cartridge extractor 530 may, in some embodiments, comprise a modified Sako®-style extractor as depicted in FIG. 5A, FIG. 5B, FIG. 5C, and FIG. 5D. In some embodiments, the cartridge extractor 530 may comprise a push-surface 522 that is configured to accept a force applied on the cartridge extractor 530 (e.g., by an extractor plunger such as the extractor plunger 120, 420 of the systems 100, 400 of FIG. 1 and/or FIG. 4 herein; not shown in FIG. 5A, FIG. 5B, FIG. 5C, and FIG. 5D). In some embodiments, the cartridge extractor 530 may comprise a first surface 532 configured to rest within an extractor channel of a bolt (not shown), a second surface 534, and/or a protrusion 536 configured to be disposed in a seat within the extractor channel (also not shown).

According to some embodiments, the cartridge extractor 530 may comprise a channel 538 cut, formed, and/or otherwise disposed within the first surface 532. The channel 538 may, for example, be configured to receive and/or couple to a rim of an ammunition cartridge (not shown). In some embodiments, the channel 538 may form and/or define, and/or the cartridge extractor 530 may otherwise comprise, a flange 540. The flange 540 may, in accordance with some embodiments, comprise one or more flange extensions 546 that extend the flange 540 transversely from each side of the first surface 532 and/or the second surface 534 by an extension amount 548. In some embodiments, the extension amounts 548 may be equivalent. According to some embodiments, the extension amounts 548 may differ, as is or becomes practicable and/or desirable.

According to some embodiments, any or all of the components 522, 532, 534, 536, 538, 540, 546, 548 of the cartridge extractor 530 (and/or the cartridge extractor 530 itself) may be similar in configuration and/or functionality to any similarly named and/or numbered components described herein. Fewer or more components 522, 532, 534, 536, 538, 540, 546, 548 (and/or portions thereof) and/or various configurations of the components 522, 532, 534, 536, 538, 540, 546, 548 may be included in the cartridge extractor 530 without deviating from the scope of embodiments described herein. In some embodiments, one or more of the various components 522, 532, 534, 536, 538, 540, 546, 548 may not be needed and/or desired in the cartridge extractor 530.

Referring now to FIG. 6A, FIG. 6B, FIG. 6C, and FIG. 6D, side, top, rear, and front views of a cartridge extractor 630 according to some embodiments are shown. The cartridge extractor 630 may, in some embodiments, comprise a modified AR-15/M-16-style extractor as depicted in FIG. 6A, FIG. 6B, FIG. 6C, and FIG. 6D. In some embodiments, the cartridge extractor 630 may comprise a first surface 632 configured to rest within an extractor channel of a bolt (not shown), a second surface 634, and/or a protrusion 636 configured to be disposed in a seat within the extractor channel (also not shown) and/or configured to be acted upon by a spring (not shown).

According to some embodiments, the cartridge extractor 630 may comprise a channel 638 cut, formed, and/or otherwise disposed within the first surface 632. The channel 638 may, for example, be configured to receive and/or couple to a rim of an ammunition cartridge (not shown). In some embodiments, the channel 638 may form and/or define, and/or the cartridge extractor 630 may otherwise comprise, a flange 640. In some embodiments, the cartridge extractor 630 may comprise a housing 642 formed on, by, and/or coupled to the first surface 632. In some embodiments, the housing 642 may comprise a hole 644 via which the cartridge extractor 630 may be rotatably coupled to a bolt and/or within the extractor channel thereof. In some embodiments, the force applied to the protrusion 636 may cause the cartridge extractor 630 to pivot about the hole 644 and/or a pin (not shown) disposed therein.

The flange 640 may, in accordance with some embodiments, comprise one or more flange extensions 646 that extend the flange 640 transversely from each side of the first surface 632 and/or the second surface 634 by an extension amount 648. In some embodiments, the extension amounts 648 may be equivalent. According to some embodiments, the extension amounts 648 may differ, as is or becomes practicable and/or desirable.

According to some embodiments, any or all of the components 632, 634, 636, 638, 640, 642, 644, 646, 648 of the cartridge extractor 630 (and/or the cartridge extractor 630 itself) may be similar in configuration and/or functionality to any similarly named and/or numbered components described herein. Fewer or more components 632, 634, 636, 638, 640, 642, 644, 646, 648 (and/or portions thereof) and/or various configurations of the components 632, 634, 636, 638, 640, 642, 644, 646, 648 may be included in the cartridge extractor 630 without deviating from the scope of embodiments described herein. In some embodiments, one or more of the various components 632, 634, 636, 638, 640, 642, 644, 646, 648 may not be needed and/or desired in the cartridge extractor 630.

Referring now to FIG. 7A, FIG. 7B, FIG. 7C, and FIG. 7D, side, top, front, and rear views of a firearm bolt assembly 710 according to some embodiments are shown. In some embodiments, the bolt 710 may comprise an end collar 710-1, a bolt handle 710-2, and/or a bolt body 710-3. Although not visible in FIG. 7A, FIG. 7B, FIG. 7C, and FIG. 7D, the end collar 710-1 may retain a firing pin assembly within the bolt body 710-3. In some embodiments, the firearm bolt assembly 710 may comprise locking lugs 712, a breech face 714, and/or a cartridge seat 716. According to some embodiments, the cartridge seat 716 may comprise a firing pin hole 716-1 through which the internal firing pin assembly (or a portion thereof, such as a firing pin) may protrude to forcibly ignite primer in a cartridge (not shown) seated in the cartridge seat 716. As depicted for non-limiting purposes of illustration only, the firearm bolt assembly 710 comprises a center-fire bolt assembly.

In some embodiments, the firearm bolt assembly 710 may comprise an extractor channel 718. According to some embodiments, the extractor channel 718 may comprise a seat 718-1, a hole 718-2, and/or a wide-flange extractor cut 718-3. The seat 718-1 may be configured to accept a protrusion from a Sako®-style extractor and/or AR-15/M-16-style extractor (not shown), for example, and/or in the case of an AR-15/M-16-style extractor, an extractor spring (also not shown). In the case of a Sako®-style extractor, the hole 718-2 may be cut into the end of the extractor channel 718 as depicted and may be configured to accept an extractor plunger and/or an extractor spring (neither of which is shown). In the case of an AR-15/M-16-style extractor, the hole 718-2 may be instead cut into one or more of the sides of the extractor channel 718 and/or may accept a pin (not shown) that rotatably attaches the AR-15/M-16-style extractor (e.g., via a housing 642 and/or hole 644 of FIG. 6A, FIG. 6B, FIG. 6C, and/or FIG. 6D herein). In some embodiments, the firearm bolt assembly 710 may comprise an ejector hole 750 configured to receive and/or accept a plunger-style ejector and/or ejector spring or mechanism (neither of which are shown).

The wide-flange extractor cut 718-3 may be configured to accept a wide-flanged extractor (not shown) as described in accordance with embodiments herein (e.g., an extractor having an extraction flange that is wider than the main body of the extractor that mounts into the narrower extractor channel 718). In such a manner, for example, the firearm bolt assembly 710 may be specially-configured to allow for coupling of a wide-flanged extractor as described herein. In some embodiments, a method may comprise machining, manufacturing, and/or modifying the firearm bolt assembly 710 to include the wide-flange extractor cut 718-3. A first cut may be made to form and/or define the extractor channel 718, for example, and a second cut (e.g., transverse to the first cut) may be made to form and/or define the wide-flange extractor cut 718-3. In some embodiments, a computer-readable medium may store specially-programmed instructions that when executed by a processing device (such as a processing device of a Computer Numerical Control (CNC) machine and/or machine tool) result in the performance of the method and/or in the creation of the wide-flange extractor cut 718-3. In some embodiments, such instructions may be stored on a computer-readable memory, which is defined herein as a subset of computer readable media that does not include transitory media types.

According to some embodiments, any or all of the components 710-1, 710-2, 710-3, 712, 714, 716, 716-1, 718, 718-1, 718-2, 718-3, 750 of the firearm bolt assembly 710 (and/or the firearm bolt assembly 710 itself) may be similar in configuration and/or functionality to any similarly named and/or numbered components described herein. Fewer or more components 710-1, 710-2, 710-3, 712, 714, 716, 716-1, 718, 718-1, 718-2, 718-3, 750 (and/or portions thereof) and/or various configurations of the components 710-1, 710-2, 710-3, 712, 714, 716, 716-1, 718, 718-1, 718-2, 718-3, 750 may be included in the firearm bolt assembly 710 without deviating from the scope of embodiments described herein. In some embodiments, one or more of the various components 710-1, 710-2, 710-3, 712, 714, 716, 716-1, 718, 718-1, 718-2, 718-3, 750 may not be needed and/or desired in the firearm bolt assembly 710.

Figure 8:
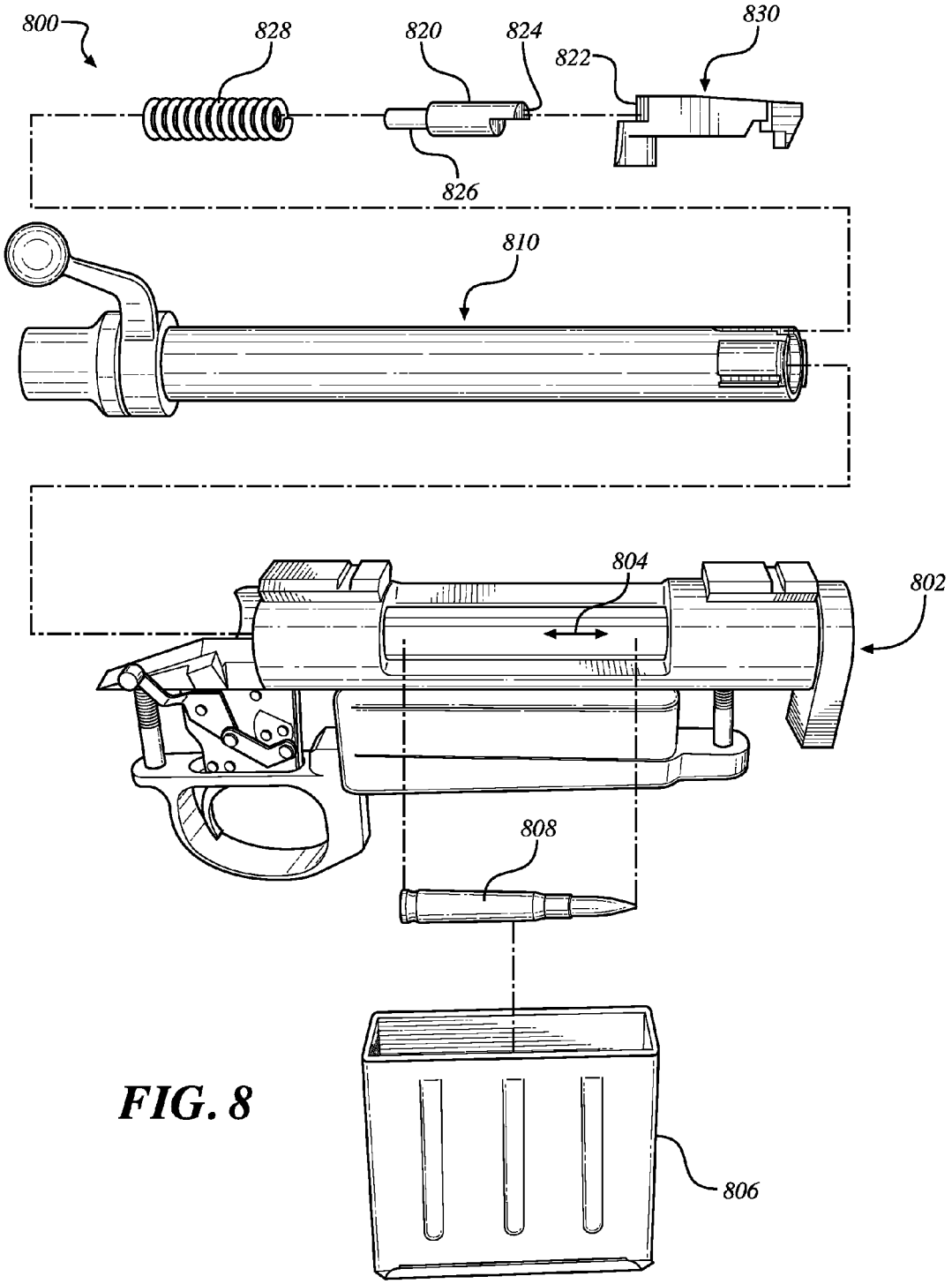
FIG. 8 is a perspective assembly diagram of a firearm system according to some embodiments.

Referring now to FIG. 8, a perspective assembly diagram of a firearm system 800 according to some embodiments is shown. As depicted for purposes of non-limiting illustration herein, the firearm system 800 comprises a receiver assembly 802 defining an ejection port 804, a magazine 806, an ammunition cartridge 708, a bolt 810, and a Sako®-style: extractor plunger 820, plunger receiver 822, plunger push surface 824, spring holder 826, extractor spring 828, and extractor 830. In some embodiments, such as in the case that an AR-15/M-16-style extractor assembly is utilized, different, fewer, and/or more extractor assembly parts may be included in the firearm system 800, as is or becomes practicable and/or desirable. According to some embodiments, the extractor 830 may comprise a wide-flanged extractor and/or the bolt 810 may comprise a wide-flanged extractor channel, seat, and/or cut or cavity, each as described in accordance with embodiments herein.

According to some embodiments, any or all of the components 802, 804, 806, 808, 810, 820, 822, 824, 826, 828, 830 of the firearm system 800 may be similar in configuration and/or functionality to any similarly named and/or numbered components described herein. Fewer or more components 802, 804, 806, 808, 810, 820, 822, 824, 826, 828, 830 (and/or portions thereof) and/or various configurations of the components 802, 804, 806, 808, 810, 820, 822, 824, 826, 828, 830 may be included in the firearm system 800 without deviating from the scope of embodiments described herein. In some embodiments, one or more of the various components 802, 804, 806, 808, 810, 820, 822, 824, 826, 828, 830 may not be needed and/or desired in the firearm system 800.

While the firearm systems 400, 800 described with respect to FIG. 4 and/or FIG. 8 herein have generally been illustrated as bolt-action rifles, many other types of firearms and/or firearm systems may benefit from the utilization of a wide-flanged cartridge extractor as described in accordance with embodiments herein. A wide-flange extractor in accordance with some embodiments may, for example, be utilized in and/or with pistols, rifles, shotguns, cannons, artillery, and/or firearm types whether having bolt-actions, repeating actions, semi-automatic actions, and/or automatic actions. Similar, while the term "cartridge" has been utilized herein to refer to ammunition and/or ammunition casings extracted from a firearm system, an ammunition and/or ammunition casing type capable of being extracted utilizing a wide-flanged extractor as generally described herein is contemplated in some embodiments, despite the terminology utilized to describe such ammunition and/or ammunition casing types (e.g., artillery "shells").

Similarly, while both Sako®-style and AR-15/M-16-style extractors and extractor assemblies have been utilized for exemplary purposes herein, any other type and/or configuration of ammunition extractor that is or becomes known and may benefit from the wide-flanged modification(s) described herein may be utilized without deviating from the scope of some embodiments.

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application. Applicant currently intends to file additional applications to pursue patents for subject matter that has been disclosed and enabled but not claimed in the present application.

What is claimed is:

1. A wide-flanged cartridge extractor, comprising:
- a first end;
- a second end, the second end being distal from the first end;
- a first portion having a first width extending from the first end toward the second end;
- a protrusion disposed on a first surface at the first end;
- a housing disposed on the first surface and along the first portion, the housing defining a pin hole extending laterally through the housing; and
- a second portion extending from the second end to the first portion, the second portion comprising a cartridge engaging flange having cartridge flange extensions, the second portion having a second width that is wider than the first width and the cartridge flange extensions extending symmetrically and transversely from the cartridge flange.

2. The wide-flanged cartridge extractor of claim 1, wherein the second portion further comprises a cartridge rim channel disposed in the first surface.

3. The wide-flanged cartridge extractor of claim 2, wherein the first portion and the second portion meet in the cartridge rim channel.

4. The wide-flanged cartridge extractor of claim 1, wherein the cartridge engaging flange is curved symmetrically outward from the first surfaces.

5. The wide-flanged cartridge extractor of claim 1, wherein the cartridge flange extensions each extend an amount equal to one half of the first width.

6. The wide-flanged cartridge extractor of claim 1, wherein the second width is between one and a half and two times as wide as the first width.

7. The wide-flanged cartridge extractor of claim 1, wherein the cartridge flange extensions extend perpendicularly from the second portion.

8. The wide-flanged cartridge extractor of claim 1, wherein the cartridge flange extensions are rectangular in shape.

9. A wide-flanged cartridge extractor, comprising:
- a first end;

a second end, the second end being distal from the first end;

a first portion having a first width extending from the first end toward the second end;

a protrusion disposed on a first surface at the first end; and a second portion extending from the second end to the first portion, the second portion comprising a cartridge engaging flange having cartridge flange extensions, the second portion having a second width that is wider than the first width and the cartridge flange extensions extending symmetrically and transversely from the cartridge flange, wherein the cartridge flange extensions are rectangular in shape.

10. The wide-flanged cartridge extractor of claim 9, wherein the second portion further comprises a cartridge rim channel disposed in the first surface.

11. The wide-flanged cartridge extractor of claim 10, wherein the first portion and the second portion meet in the cartridge rim channel.

12. The wide-flanged cartridge extractor of claim 9, wherein the cartridge engaging flange is curved symmetrically outward from the first surfaces.

13. The wide-flanged cartridge extractor of claim 9, wherein the cartridge flange extensions each extend an amount equal to one half of the first width.

14. The wide-flanged cartridge extractor of claim 9, further comprising:

a housing disposed on the first surface and along the first portion, the housing defining a pin hole extending laterally through the housing.

15. The wide-flanged cartridge extractor of claim 9, wherein the second width is between one and a half and two times as wide as the first width.

16. The wide-flanged cartridge extractor of claim 9, wherein the cartridge flange extensions extend perpendicularly from the second portion.

* * * * *